United States Patent [19]

Lubahn

[11] Patent Number: 4,856,450

[45] Date of Patent: Aug. 15, 1989

[54] ANCHORING METHOD AND DISPLAY APPARATUS FOR USE THEREIN

[76] Inventor: Douglas H. Lubahn, 317 W. 77th St., Apartment 2-F, New York, N.Y. 10024

[21] Appl. No.: 193,856

[22] Filed: May 13, 1988

[51] Int. Cl.[4] ..... B63B 21/00

[52] U.S. Cl. ..... 114/293; 114/270; 114/364

[58] Field of Search ..... 114/294, 270, 293, 343, 114/364; 33/126, 126.5, 134 R, 126.6; 43/27.4, 4, 25

[56] References Cited

U.S. PATENT DOCUMENTS

| | | | |
|---|---|---|---|
| 2,669,785 | 2/1954 | Rydzewski | 33/126.5 |
| 3,217,291 | 11/1965 | King | 33/126.5 |
| 3,352,017 | 11/1967 | Newberg | 114/294 |
| 3,722,268 | 3/1973 | Crooke et al. | 33/126.5 |

*Primary Examiner*—Joseph F. Peters, Jr.
*Assistant Examiner*—Edwin L. Swinehart
*Attorney, Agent, or Firm*—Cohen, Pontani & Lieberman

[57] ABSTRACT

A method for insuring safe anchorage comprising anchoring or mooring a boat, determining the anchor rode for the anchored or moored boat, and displaying, for the anchored or moored boat, in a location visible to incoming vessels, an indicia indicative of the scope ratio for the boat.

15 Claims, 3 Drawing Sheets

FIG. 1
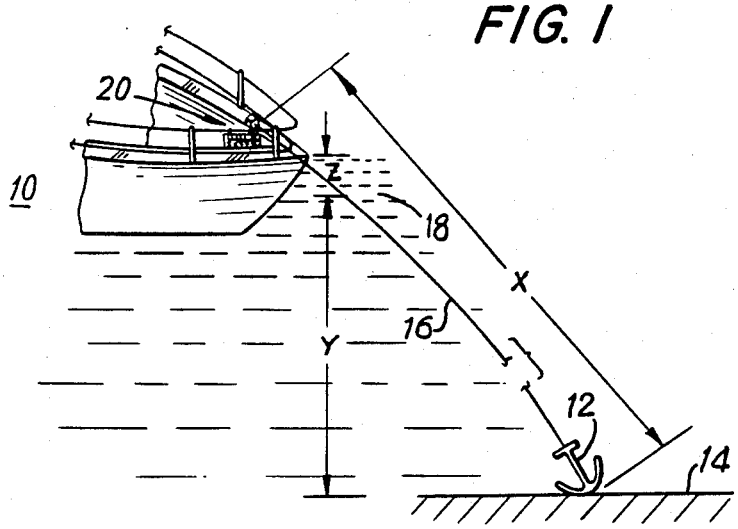
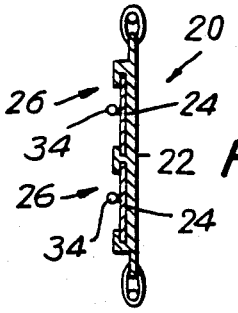
FIG. 3
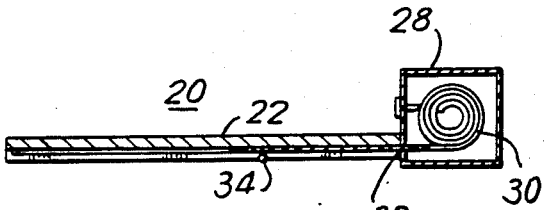
FIG. 4

ANCHORING METHOD AND DISPLAY APPARATUS FOR USE THEREIN

BACKGROUND OF THE INVENTION

1. Field of the Invention

This invention pertains to boating, and more particularly to techniques for safely anchoring or mooring a plurality of boats in nonoverlapping and noninterfering locations in an anchorage. This invention also relates to a device for displaying and indicating to other vessels the relevant characteristics of a moored or anchored boat.

2. Prior Art

There are three principal ways to secure a boat when not in use, namely, docking the boat at a slip, mooring the boat in a generally protected area, or dropping anchor in open water. Several considerations come into play when anchoring or mooring a boat. For example, in crowded anchorages, it is desirable for larger boats to anchor in deeper water farther from shore, leaving shallow, sheltered spots for the smaller boats. This is not only an efficient use of available space, but also reduces the effects of waves on the smaller boats. Another, principal consideration in selecting a safe anchorage or mooring site is a determination of the amount of anchor line, also known as anchor rode, to pay out. Not only is this an important factor in the holding power of the anchor, it also determines the size of the circle circumscribed by the boat as it swings about its anchor with changes in tide, wind direction, etc.

Since, for a given anchor rode, the size of the circle circumscribed by the boat about its mooring is also dependent on water depth, the length of anchor rode payed out between the bow and the tackle is usually expressed in terms of "scope", which is defined as the ratio of the length of the anchor rode divided by the distance from the bow to the bottom. So, for example, in 20 feet of water, with a bow 5 feet off the water, 150 feet of anchor rode would result in a scope ratio of six-to-one. Typically, scope ratios for combination rope and chain anchor rodes range from five-to-one to ten-to-one, with seven or eight-to-one being common in average conditions. For safety and uniformity, scope ratios are calculated at high tide.

Because the scope ratio determines the size of the circle the boat makes about its anchor, failure to select a proper scope ratio, especially in a crowded anchorage, can be disastrous. For example, if a boat selects a mooring or anchor site a few boat lengths astern of a previously moored or anchored boat, which is generally accepted as a safe distance, the second boat may nevertheless swing into the first if the scope ratio of either boat is too high or too low. Accordingly, it is important for the second boat to be aware of the scope ratio of the first boat when selecting its own scope ratio and mooring or anchoring location.

When a stiff breeze is blowing, a reasonably skilled skipper can determine the scope ratio of anchored boats by the angle their anchor lines make with the water, i.e., the more acute the angle between the anchor line and the water, the higher the scope ratio. However, in light air, a boat can drift over its anchor, presenting the appearance of a low scope ratio when, in fact, the scope ratio may be higher. This situation is complicated by the fact that the scope ratio for all-chain rodes should be from about three-to-one to five-to-one whereas, as noted, the scope ratio for combination rope and chain anchor rodes generally ranges from about five-to-one to about ten-to-one.

The desired scope ratio for one's own boat can be readily attained by labeling the anchor rode at regular intervals, as with ribbons, plastic tags, etc. For example, if the anchor rode is marked every 6 feet, the skipper can readily determine the amount of anchor rode to pay out to achieve a desired scope ratio if the water depth and bow height are known. Thus, for a water depth of 10 feet and a bow height of 5 feet, a scope ratio of six-to-one is achieved by paying out 90 feet of anchor rode, or 15 ribbons.

Ideally, all boats at an anchorage should be moored or anchored with about the same scope ratio but, as noted, for example, in the article "Proper Etiquette In The Anchorage", Sail Magazine, October, 1987, "this hardly ever happens". Oftentimes, skippers put out abnormally long or short anchor lines. Also, for the reasons noted above, it is not always easy or possible to determine the scope ratio of other boats by observing the angles their anchor lines make with the water line. Since the fault for any collisions occurring between two boats during swinging will generally be attributed to the second vessel to anchor or moor, the first having the equivalent of squatter's rights, it is all the more important that boats coming into an occupied anchorage be able to properly assess the scope ratios of boats already anchored or moored so that they can select a safe location in which to anchor or moor. Nevertheless, and as noted, this is not always easy.

Accordingly, it is an object of the present invention to provide a method whereby incoming boats will be able to readily determine the scope ratios of previously anchored or moored boats.

SUMMARY OF THE INVENTION

The present invention provides a method for insuring safe anchorage which comprises advising incoming vessels of the scope ratios of vessels already anchored or moored. In particular, the method of the present invention comprises anchoring or mooring a boat; determining the anchor rode for the anchored or moored boat; and displaying for that boat, in a location visible to incoming vessels, an indicia indicative of the scope ratio thereof.

Preferably, the displayed indicia comprises a number representing the length of the anchor rode expressed, for example, in feet. Incoming vessels can then calculate the scope ratio for the anchored or moored boat by simply dividing the anchor rode by the sum of the water depth and the distance from the bow to the water line. This is considered preferable to directly displaying the scope ratio, as the calculation of scope ratio is dependent on the distance from the water line to the bottom, i.e. water depth, which changes with tide shifts. Therefore, it is considered preferable to simply display a number representing the length of the anchor rode, whereupon incoming vessels can easily calculate the scope ratio for the anchored or moored boat. Accordingly, as used herein, the term "an indicia indicative of scope ratio" should be understood to include scope ratio or any dimension, such as anchor rode, from which scope ratio can be determined.

So, for example, if the display on an anchored or moored vessel indicates an anchor rode of 150 feet, the incoming vessel, utilizing charts or a depth gauge, can determine the depth of the water for the anchored or moored boat. By adding the water depth to the distance from the water line to the bow, a distance easily determined by observation, the skipper of the incoming vessel can readily calculate the scope ratio of the anchored or moored boat.

The display indicating the length of the anchor rode may be placed at any suitable location on or near the anchored or moored boat, or at a plurality of locations about the boat, such that it will be visible from any approach. For example, a sign secured to lifelines or stays on the boat may be used. Alternatively, a flag displaying the anchor rode may be employed. As a still further alternative, the display apparatus could be automated. For example, a sensor could be employed to automatically sense the length of anchor rode paid out and provide a signal indicative thereof to a display, such as an electrically-powered display, especially an LED or liquid crystal display. The electrically-powered (e.g., LED or liquid crystal) display could be used in lieu of a manual display, or for providing the information to be displayed on the manual display, thereby eliminating the possibility of human error.

Further features and advantages of the method in accordance with the present invention will be more fully apparent from the following detailed description and annexed drawings of the presently preferred embodiment thereof.

BRIEF DESCRIPTION OF THE DRAWINGS

In the Drawings

FIG. 1 is a partially perspective, partially diagrammatic representation of an anchored or moored boat;

FIG. 3 is a sectional view taken substantially along the lines 3—3 in FIG. 2;

FIG. 4 is a sectional view taken substantially along the lines 4—4 in FIG. 2.

DETAILED DESCRIPTION OF THE PREFERRED EMBODIMENT

Figure 2:
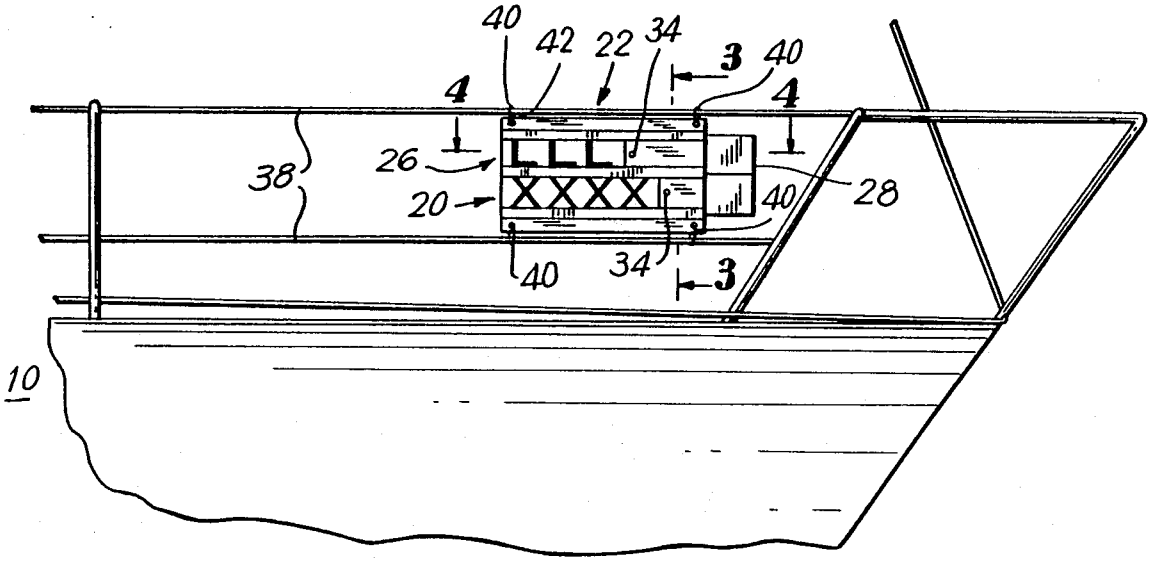
FIG. 2 is an elevational view of an apparatus suitable for practicing the method of the present invention.

Before proceeding to a description of the currently preferred embodiments of the present invention, it should be understood that the method and apparatus of the invention may be applied to any watercraft or, indeed, to any floating object which is positionally-secured or fixed in the water by an anchor or the like. Thus, as used herein the terms "boat" and "vessel" are intended to include all such floating objects whether or not normally referred to by one of those terms. Similarly, the terms "moored" and "anchored" are used interchangeably throughout this disclosure and the use herein of one of those terms in lieu of the other is not intended to denote a limitation of the method or manner by which a floating object is positionally-secured or fixed in the water.

Referring now to the drawings, the preferred method in accordance with the present invention will now be described. The method will be described in connection with a boat 10 which has anchored by dropping its anchor 12 to the bottom 14 using a length x of anchor rode 16. In the example shown, the water depth at high tide is y and the distance from the water line 18 to the bow is z. In accordance with conventional terminology, the scope ratio for the boat 10 is $$\text{scope ratio} = x/(y+z) \qquad \text{[Equation A]}$$

In the foregoing equation, high tide is assumed. If the calculation is not made at high tide, y should be increased accordingly when calculating the scope ratio.

In accordance with the method of the present invention, the skipper of the boat 10, upon anchoring, measures the anchor rode of his vessel. He then displays that number on a display 20 specifically provided for that purpose. Then, all an incoming skipper need know is the water depth y and the distance z from the bow to the water line for the boat 10, whereupon the scope ratio of the anchored boat can be easily calculated by simple division in accordance with Equation A. Once the scope ratio of the boat 10 is known, the skipper of the incoming vessel can select a mooring site and scope ratio with the confidence that his selection will avoid any possible interference with the boat 10 as the boats swing around their anchors during changes in tide, wind direction, etc. In the absence of the display 20, the skipper of the incoming vessel could only estimate the scope ratio of the anchored boat 10 based on experience and the angle formed by the anchor rode 16 with the water line 18. In a crowded anchorage, a bad estimate can lead to disaster. The method of the invention, by taking the guesswork out of the incoming skipper's calculation of the scope ratio of the boat 10, avoids this risk.

Once this description is known, those of ordinary skill in the art will appreciate that the display 20 may take a variety of forms, provided that it serves its intended function of informing incoming skippers of the length of the anchor rode of the anchored vessel 10. With particular reference to FIGS. 2–4, one suitable display 20 will now be described. As there shown, the display 20 comprises a base 22 defining a pair of channels 24 open on one side 26. As best seen in FIG. 2, imprinted on the back wall of the upper channel 24 are a plurality of roman numerals "L". Similarly, imprinted on the back wall of the lower channel 24 are a plurality of roman numerals "X". A housing 28 is formed on one side of the display 20. The housing 28 houses a pair of coiled flexible members 30, one for each channel 24, only the upper coiled member 30 being visible in FIG. 4. The free end of each coiled member 30 extends through an opening 32 on one side of the housing 28 and into its respective aligned channel 24. As shown, a knob 34 is secured to the free end of each flexible member 30 such that the length of the flexible members 30 extending into the channels 24 may be controlled by utilizing the knobs 34 to slide the flexible members 30 back and forth in the channels. Any suitable mechanism may be employed to insure that the flexible members 30 coil inside the housing 28 in a manner that avoids tangling or fouling. Suffice it to say that such mechanism may comprise, for example, a mechanism similar to that found in conventional tape measurers without, however, a spring bias for retracting the flexible member when not in use.

From the foregoing it will be apparent that the skipper of the boat 10 may indicate to incoming vessels the length of anchor rode for the boat 10 by manipulating the knobs 34 to expose the correct number of roman numerals L and X. For example, in the example shown, three L's are exposed in the upper channel 24 and four X's in the lower channel. Under the convention proposed, the conventional roman numeral L's and X's would simply be added to yield the length of the anchor rode. So, in FIG. 2, the displayed anchor rode is 190 feet. While roman numerals are preferred for their nautical and pleasing appearance, any other suitable convention may be adopted. For example, a display could be fashioned in which any arabic number from 1–15 could be exposed, with the exposed number, multiplied by 10, indicating the length of anchor rode.

In addition to displaying the anchor rode, the display could be modified to indicate whether or not the anchored boat has an all-chain rode. As noted above, an all-chain rode dictates a much lower scope ratio as compared to a combination rope and chain rode. Accordingly, an incoming vessel with a combination rope and chain rode would be wise to anchor clear of boat with all-chain rodes to avoid the possibility of collision as the boats swing about their anchors, as the boat with the all-chain rode will swing in a much smaller circle than the boat with the combination rope and chain rode. So, for example, the display 20 could be modified to incorporate an additional letter "C", which would be exposed in the case of an all-chain rode and covered or otherwise obscured in the case of a conventional combination rope and chain rode.

The display 20 can be supported at any location on or near the boat 10 which assures easy visibility by incoming vessels. In the example shown, the display 20 is supported between a pair of lifelines 38 by a plurality of hooks 40 extending through holes 42 in the base 22 and about the lifelines 38. As an alternative, each skipper could carry a plurality of flags bearing indicia indicating different lengths of anchor rode, the appropriate flag being raised when the boat is anchored.

Figure 5:
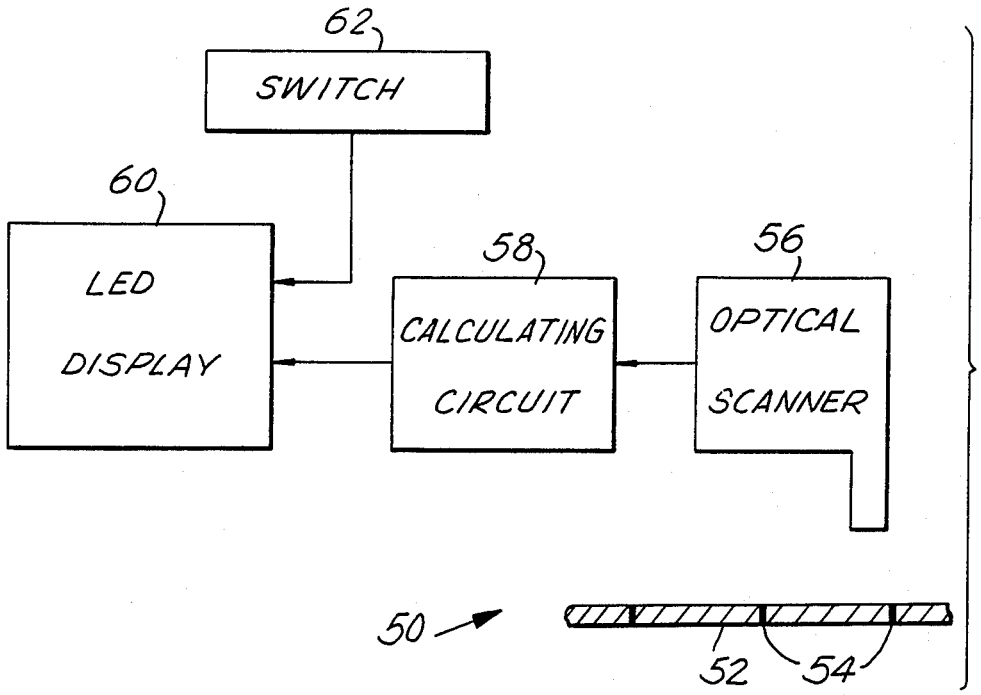
FIG. 5 is a diagrammatic view of an automated display arrangement in accordance with the invention.

Instead of manually determining the anchor rode, as by counting ribbons tied to the rode at equal intervals, a suitable sensing device 50 (FIG. 5) could be employed to automatically determine the length of the rode. For example, the rode 52 could be marked with reflective bands 54 spaced at equal intervals which could then be counted by an optical scanner 56 as the rode is paid out. Assuming each band is ten feet from the next, a simple calculating circuit 58 could multiply the number of counts by ten to arrive at the length of rode paid out, which could then be displayed electronically, as on an LED display 60. If the display is sufficiently large and bright, it could be used in lieu of a manual display, such as the display 20. If this is done, a simple switch 62 could be incorporated for selectively displaying a "C" or other denotation to indicate an all-chain rode. Alternatively, the electronic display could be used solely for the skipper's reference for setting the manual display, as this arrangement will still obviate the need for the skipper to manually calculate the length of rode paid out, which calculation is always subject to human error. As one possibility, the sensor, calculating circuit, and electronic display could be incorporated on a windlass for the anchor line such that the length of rode paid out is displayed directly on the windlass.

From the foregoing description, it will be apparent that the method of the present invention provides a simple but effective technique for advising incoming skippers of the anchor rode of all anchored or moored boats from which their scope ratios can be easily calculated. Once the scope ratios of the anchored boats are known, the skipper of an incoming vessel can choose an anchoring site and scope ratio sufficient to avoid any possibility of collision as the boats swing about their anchors. No longer is guesswork required to estimate the scope ratios of anchored boats.

While display of the anchor rode is preferred, it will be appreciated that a similar result can be obtained by directly displaying the scope ratio. However, it is presently preferred to display anchor rode, not scope ratio, since this removes as a possible source of error an improper calculation of scope ratio by the skipper of the anchored boat 10—for example, by the skipper's using, as the distance y, a figure other than the high tide water depth. Direct display of the anchor rode places the onus for a correct calculation on the incoming skipper, which is appropriate since admiralty rules place the responsibility of selecting a safe mooring site on the incoming skipper. Of course, whatever system is adopted, i.e., the direct display of the scope ratio or display of the anchor rode, it must be consistent for all vessels so that there will be no confusion. Alternatively, a convention could be adopted whereby boats displaying anchor rode would utilize a roman numeral display, and those displaying scope ratio would use an arabic numeral display.

While there has herein been shown and described the currently preferred method and apparatus of the present invention and certain suggested modifications thereto, it will be apparent to those of ordinary skill in the art that still further changes and modifications may be made therein without departing from the spirit and scope of the invention. Accordingly, the above description should be construed as illustrative and not in a limiting sense, the scope of the invention being defined by the following claims.

What is claimed is:

1. A method for insuring safe anchorage, comprising:
anchoring a boat;
measuring the length of the anchor rode for the anchored boat; and
displaying on an exterior portion of said anchored boat, in a location visible to incoming vessels at a distance from and abeam of the anchored boat, indicia relating to the scope ratio for said anchored boat and displayed so as to be readable from said incoming vessels for use in safe anchoring of said incoming vessels.

2. The method according to claim 1, wherein said displayed indicia is a numeral representation of the anchor rode length for said anchored boat.

3. The method according to claim 1, wherein said displayed indicia is a numeral representation of the scope ratio for said anchored boat.

4. Apparatus for informing nearby vessels of the length of anchor rode of an anchored boat so as to facilitate safe and nonoverlapped anchoring of vessels with respect to said anchored boat, said apparatus comprising:
a. a base;
b. means for attaching said base to a visible exterior portion of the anchored boat; and
c. indicating means, associated with said base, for displaying indicia relating to the length of anchor rode payed out from the boat so that said indicia are readily visible from a nearby vessel for enabling determination from the displayed indicia of the amount of anchor rode to pay out from the nearby vessel in anchoring the vessel whereby the vessel may be safely anchored in nonoverlapping and noninterfering proximity to the anchored boat.

5. The apparatus of claim 4, wherein said indicating means comprises an electrically-powered display.

6. The apparatus of claim 5, further comprising. means for sensing the amount of anchor rode payed out, said sensing means being operatively connected to said indicating means for automatically displaying indicia relating to the amount of anchor rode payed out from the boat.

7. The apparatus of claim 6, wherein said sensing means comprises an optical scanner.

8. The apparatus of claim 4, further comprising means for sensing the amount of anchor rode payed out, said sensing means being operatively connected to said indicating means for automatically displaying indicia relating to the amount of anchor rode payed out from the boat.

9. The apparatus of claim 8, wherein said sensing means comprises an optical scanner.

10. In a boat, the improvement comprising a display for indicating either the length of anchor rode payed out or the scope ratio when the boat is anchored, said display including:

a. a base;

b. means for attaching said base to a readily visible exterior portion of the boat; and c. indicating means, associated with the base, for displaying in a manner readily visible to a nearby boat indicia corresponding to either the length of anchor rode payed out or the scope ratio of the anchored boat and from which indicia a skipper of a nearby boat may determine the appropriate amount of anchor rode to pay out for the nearby boat so as to anchor the nearby boat in sate and nonoverlapping and noninterfering proximity to the anchored boat.

11. In the boat of claim 10, said indicating means comprising an electrically-powered display.

12. In the boat of claim 11, said display further comprising means for sensing the amount of anchor rode payed out, said sensing means being operatively connected to said indicating means for automatically displaying readily visible indicia corresponding to either the amount of anchor rode payed out from or the scope ratio of the anchored boat.

13. In the boat of claim 12, said sensing means comprising an optical scanner.

14. In the boat of claim 10, said display further comprising means for sensing the amount of anchor rode payed out, said sensing means being operatively connected to said indicating means for automatically displaying readily visible indicia corresponding to either the amount of anchor rode payed out from or the scope ratio of the anchored boat.

15. In the boat of claim 14, said sensing means comprising an optical scanner.

* * * * *